US008567496B2

(12) United States Patent
Taylor et al.

(10) Patent No.: US 8,567,496 B2
(45) **Date of Patent: *Oct. 29, 2013**

(54) SYSTEM AND METHOD FOR MANAGING A SUBTERRANEAN FORMATION

(75) Inventors: Stewart Thomas Taylor, Farmers Branch, TX (US); Joel Le Calvez, Farmers Branch, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/421,157

(22) Filed: Mar. 15, 2012

(65) Prior Publication Data

US 2012/0168151 A1 Jul. 5, 2012

Related U.S. Application Data

(63) Continuation of application No. 12/690,554, filed on Jan. 20, 2010, now Pat. No. 8,157,011.

(51) Int. Cl.
*E21B 43/263* (2006.01)
*E21B 47/12* (2012.01)
*E21B 49/04* (2006.01)

(52) U.S. Cl.
USPC ..... 166/250.1; 166/55.2; 166/177.1; 166/249; 166/308.1; 175/1

(58) Field of Classification Search
None
See application file for complete search history.

(56) References Cited

U.S. PATENT DOCUMENTS 7,134,492 B2 11/2006 Willberg et al.
7,967,069 B2 6/2011 Beasley
8,157,011 B2 4/2012 Taylor et al.
2005/0197781 A1 9/2005 Harmon et al.
2009/0166029 A1 7/2009 Maksimenko et al.
2009/0168599 A1 7/2009 Suarez et al.

FOREIGN PATENT DOCUMENTS

WO 2008002271 A1 1/2008
WO 2009004333 A1 1/2009

OTHER PUBLICATIONS

Barrewe, R.D. et al., "A Practical Guide to Hydraulic Fracture Diagnostic Technologies", Society of Petroleaum Engineers, paper 77442, 2002.
Daneshy, A. Ali, "Off-Balance Growth: A New Concept in Hydraulic Fracturing", Society of Petroleum Engineers, paper 80992, Apr. 2003, pp. 78-85.
Jeffrey, R.G. Jr. et al., "An Analysis of Hydraulic Fracture and Mineback Data for Treatment in the German Creek Coal Seam", Society of Patroleum Engineers, paper 24362, 1992, pp. 445-457.
Medlin, W.L. et al., "Abnormal Treating Pressures in Massive Hydraulic Fracturing Treatments", Journal of Petroleum Technology, May 1988, pp. 633-642.
Smith et al., "Chapter 5: Basics of Hydraulic Fracturing," Reservoir Stimulation, 3rd Edition, John Wiley & Sons: Chicester, eds. Economides et al., Jun. 2000: pp. 5-1-5-28.
Zhang et al., "The role of friction and secondary flaws on deflection and re-initiation of hydraulic fractures at orthogonal pre-existing fractures," Geophysical Journal International, Sep. 2006, vol. 166(3): pp. 1454-1465.

*Primary Examiner* — Zakiya W Bates
(74) *Attorney, Agent, or Firm* — Colin Wier; Rodney Warfford

(57) ABSTRACT

A system and method for managing a well site having a subterranean formation. The method comprises determining a first spectral attenuation of a first seismic wave measured from a first location, determining a second spectral attenuation of a second seismic wave measured from a second location, determining a reservoir attenuation anisotropy from a comparison of the first spectral attenuation to the second spectral attenuation, and determining at least one fracture parameter of the subterranean formation from a comparison of the first seismic wave to the second seismic wave.

28 Claims, 10 Drawing Sheets

SYSTEM AND METHOD FOR MANAGING A SUBTERRANEAN FORMATION

CROSS-REFERENCE TO RELATED APPLICATIONS

This application is a continuation and claims the benefit of U.S. patent application Ser. No. 11/648,035 filed 29 Dec. 2006, which is incorporated herein by reference in its entirety.

BACKGROUND

The present invention relates to techniques for performing oilfield operations. More particularly, the present invention relates to techniques for performing fracture operations, such as stimulation, on a subterranean formation having at least one reservoir therein.

Oilfield operations are typically performed to locate and gather valuable downhole fluids. Typical oilfield operations may include, for example, surveying, drilling, wireline testing, completions, production, planning, and oilfield analysis. One such oilfield operation is a fracture operation used to facilitate production of fluids from a reservoir positioned in a subterranean formation. The fracture operation may involve, for example, fracturing, stimulation, seismic wave generation, measurement, testing and/or analysis. Fracturing typically involves the injection of a fracturing fluid into a subterranean formation to create or expand existing fractures in the reservoir.

In some cases, the fracturing fluid may contain proppants, such as sand grains, ceramic grains and/or other small particles, for creating a high conductivity drain in the formation. The fractures generated during a fracture operation may be simple fractures (e.g., bi-wing), or a complex networks of fractures that extend through the formation. These fractures create pathways between the reservoir and the wellbore to enable fluids to flow to the surface.

In performing fracture operations, it is often helpful to know certain fracture parameters, such as the hydraulic conductivity, the fracture width, fracture density, fracture porosity, local stress field, reservoir attenuation anisotropy, fracture velocities, the fluid pressure, the fracture length, fracture permeability, and/or the fracture conductivity. These fracture parameters may also include parameters of the reservoir, formation and/or other portions of the well site. Techniques have been developed to measure and/or map fractures as described, for example, in U.S. Patent/Application Nos. 7,134,492 and 2009/0166029. In some cases, seismic tools may be used to measure well site parameters. The use of downhole seismic techniques have been as described, for example, in PCT application PCT/GB2008/002271 and US Patent Application No. 2009/0168599.

Despite the advancements in fracture and seismic techniques, there remains a need to enhance fracture operations in subterranean formations and reservoirs contained therein. It is desirable that such techniques involve a more accurate determination of fracture parameters for simple and complex fractures. It is further desirable that such techniques consider the effects of stimulation of the subterranean formation and/or reservoir. Preferably, such techniques enable, one or more of the following, among others: mapping simple and/or complex fracture networks, determining fracture parameters, stimulating the formation, providing images of the fracture(s), providing calibrations, monitoring and/or interpreting microseismic events.

SUMMARY

The present invention relates to a method for managing a well site having a subterranean formation. The method comprises determining a first spectral attenuation of a first seismic wave measured from a first location, determining a second spectral attenuation of a second seismic wave measured from a second location, determining a reservoir attenuation anisotropy from a comparison of the first spectral attenuation to the second spectral attenuation, and determining at least one fracture parameter of the subterranean formation from a comparison of the first seismic wave to the second seismic wave.

The present invention also relates to a system for performing a fracture operation on a subterranean formation. The system comprises a first seismic source positioned at a first location about the subterranean formation for generating a first seismic wave therethrough, a second seismic source positioned at a second location about the subterranean formation for generating a second seismic wave therethrough, and a receiver positionable about the subterranean formation for receiving reflections of the first and second seismic waves. The system further comprises a reservoir management unit for determining at least one fracture parameter of the subterranean formation by comparing the first seismic wave to the second seismic wave, determining a first spectral attenuation of the reflections of the first seismic wave, determining a second spectral attenuation corresponding to reflections of the second seismic wave, and determining a reservoir attenuation anisotropy from a comparison of the first spectral attenuation to the second spectral attenuation.

The present invention also relates to a system managing a well site having a subterranean formation. The system comprises a controller configured to determine a first spectral attenuation of a first seismic wave measured from a first location, determine a second spectral attenuation of a second seismic wave measured from a second location, determine a reservoir attenuation anisotropy from a comparison of the first spectral attenuation to the second spectral attenuation, and determine at least one fracture parameter of the subterranean formation from a comparison of the first seismic, wave to the second seismic wave.

BRIEF DESCRIPTION OF THE DRAWINGS

The present embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DESCRIPTION OF EMBODIMENT(S)

The description that follows includes exemplary apparatus, methods, techniques, and instruction sequences that embody techniques of the present inventive subject matter. However, it is understood that the described embodiments may be practiced without these specific details.

Figure 1:
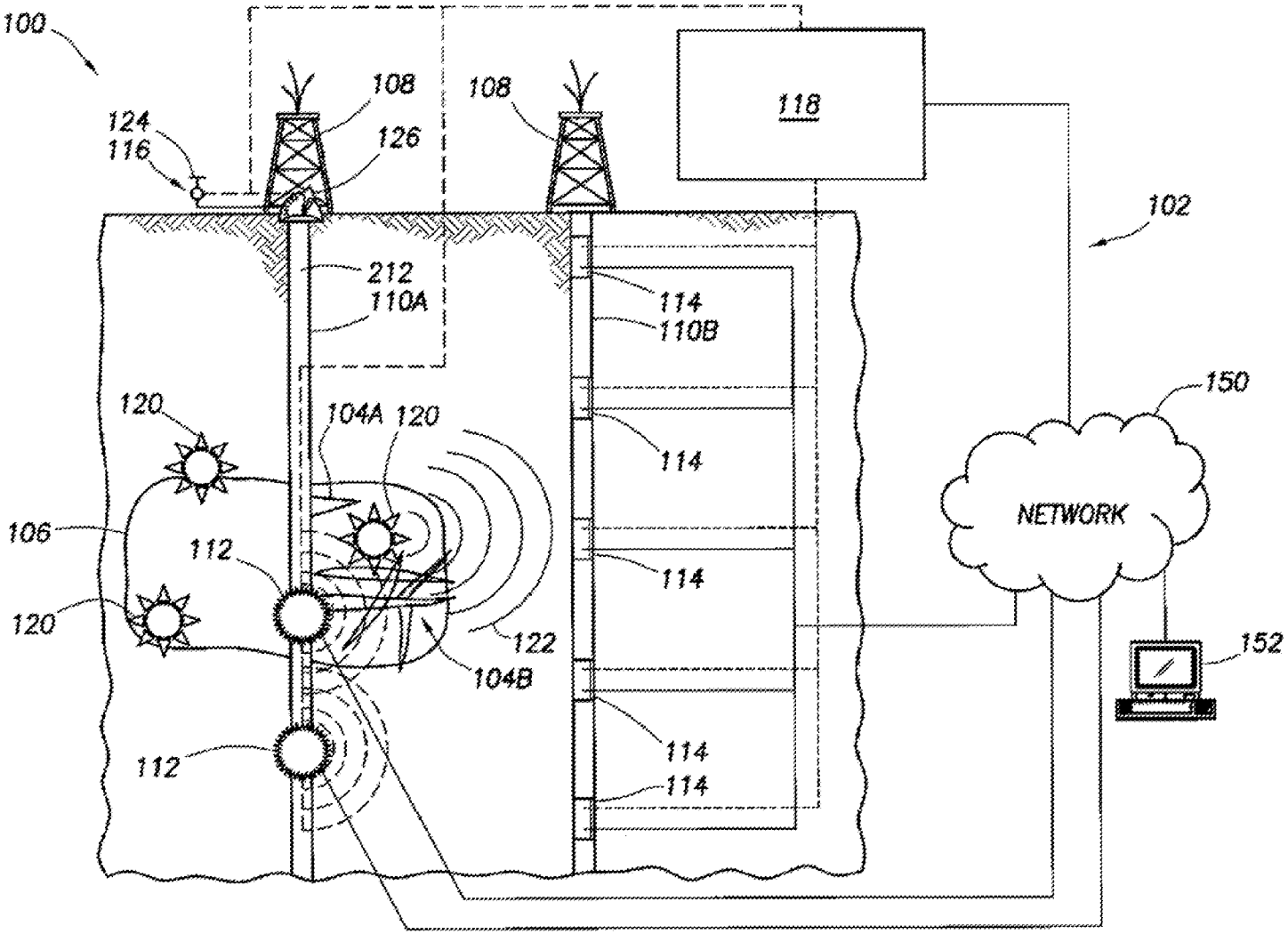
FIG. 1 is a schematic view of a well site having a system for performing a fracture operation, the system comprising a seismic source, a seismic receiver and a controller.

FIG. 1 depicts a schematic view of a well site 100 including a system 102 for performing fracture operations for one or more fracture networks 104A, B in a subterranean formation 105 having a reservoir 106 therein. As shown, the well site 100 is a land based well site with rigs 108. However, it will be appreciated that the well site 100 may be land or water based, with one or more well sites 100 for producing from one or more reservoirs 106 in the subterranean formation 105.

As shown, the well site 100 includes a production wellbore 110A and a monitoring wellbore 110B. The well site 100 may further include associated well site tools (not shown) for completing the wellbore 110A and/or producing from the reservoir 106. The system 102 may include one or more controlled seismic sources 112, one or more receivers 114, a stimulation system 116, and a controller 118. In addition to the controlled seismic sources 112, there may be any number of randomly occurring microseismic events 120 occurring in, or near, the reservoir 106.

The subterranean formation 105 may be rock formations containing reservoirs 106 having oil, gas, water and/or other fluids therein. The subterranean formations 105 may have naturally occurring fractures and/or flow pathways that permit the flow of fluids therethrough. Creating new fractures and/or expanding the pre-existing fractures for fluid communication with the wellbore 110 may be used to enhance production of fluids from the reservoir 106.

Figure 2:
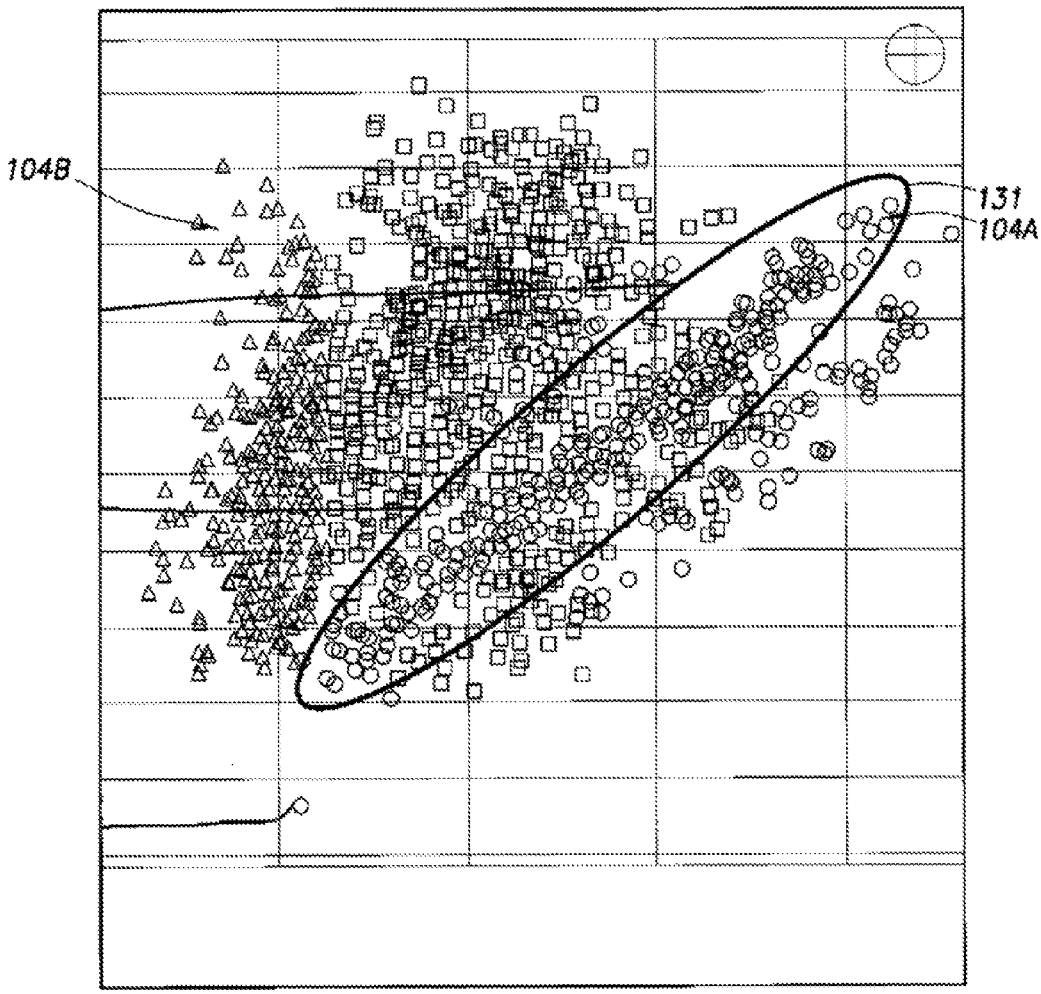
FIG. 2 is a plot depicting a bi-wing tensile fracture and a complex fracture.

Examples of fractures that may be created and/or pre-existing in the subterranean formation 105 are schematically depicted in FIGS. 1 and 2. The fracture network 104 may have a simple bi-wing fracture 104A and/or a complex fracture 104B. FIG. 2 shows the bi-wing fracture 104A as represented by spheres, and the complex fracture networks 104B as represented by triangles. As shown in these figures, the complex fracture network 104B may have a larger lateral spread, while the bi-wing fracture has a more planar structure with most of the microseismic events being concentrated within an elliptical area 131. The fractures 104A and/or 104B may be naturally occurring fractures enhanced by the stimulation or the result of a stimulation of the reservoir 106.

Referring still to FIG. 1, the controlled seismic source 112, shown schematically, is a perforating gun in the wellbore 110A for creating one or more seismic waves 122 in the reservoir 106. The perforation guns may be used at various locations in the wellbore 110A to pierce casing, or other piping in the wellbore (if present) and penetrate the subterranean formation 105. The controlled seismic source 112 may be moved to any location of interest and initiated by an operator or the controller 118, in order to generate the seismic wave 122. The location of interest may be, for example, a position adjacent to the fracture network 104A, B.

The controlled seismic source 112 differs, from the microseismic events 120 in that the controlled seismic source 112 may be moved proximate the location of interest and initiated. The controlled seismic source 112 may be any suitable device for creating a seismic wave including, but not limited to, perforating guns, vibrators, charges, airguns, string shot, sparkers, and the like. The one or more seismic sources 112 may be positioned about the well site 100 to initiate one or more seismic source events for measurement. The seismic waves 122 typically propagate away from the controlled seismic source 112, and are detected by the one or more receivers 114.

As shown, the receivers 114 may be conventional geophones known in the art. The geophones are sensitive ground motion transducers that measure vibrations in the ground by converting ground movement into voltage. The voltage may be amplified and recorded by a voltmeter. The receivers 114 may send data regarding the seismic waves to the controller 118. Although the one or more receivers 114 are described as being one or more geophones, it should be appreciated that the receivers 114 may be any suitable device for collecting seismic data, such as a versatile seismic imager, a geophone accelerometer, accelerometers, any number of three-component geophones, and the like.

The receivers 114, as shown, are located in the monitoring wellbore 110B at certain depths for taking measurements. The receivers 114 may be located at a depth proximate to the location of interest, or at an optimal location depending on various factors, such as the rock matrices, formation structures and/or other variables. The one or more receivers 114 may be positioned at various locations in one or more wellbores (monitoring and/or production) suitable for collecting data regarding the seismic waves 122.

A network 150 is provided for communicating between the well site 100 and one or more offsite communication devices 152, such as one or more computers, personal digital assistants, and/or other networks. The network 150 may communicate using any combination of communication devices or methods, such as telemetry, fiber optics, acoustics, infrared, wired/wireless links, a local area network (LAN), a personal area network (PAN), and/or a wide area network (WAN). Connection may also be made to an external, computer (for example, through the Internet using an Internet Service Provider).

The controller 118 may be configured to monitor, analyze and control various aspects of the well site 100. The controller 118 may be in communication via one or more communication links with various components and systems associated with the well site 100, such as the controlled seismic source 112, the one or more receivers 114, the stimulation system 116, the operator, and/or remote locations. Communication may also be passed between the controller 118 and the network 150.

The stimulation system 116 may be any suitable system for stimulating, or treating the reservoir 106. A fracture fluid is preferably pumped into the reservoir 106 to fracture the subterranean formation, thereby allowing the fracture fluid (and proppant if present) to enter and extend the existing fractures. The fracturing of the rock formations may create more complex fracture networks 104B. The stimulation system 116 may include any number of tools for facilitating the fracturing of the fracture networks 104, such as one or more pumps 124, and/or packers, tubing, coil (CT), and the like. The stimulation system 116 may further include a pressure sensor 126 for measuring stimulation parameters, such as pressure changes in the fracture fluid as the reservoir 106 is stimulated. These stimulation parameters may provide information to the controller 118 and/or the network 150.

Figure 3A:
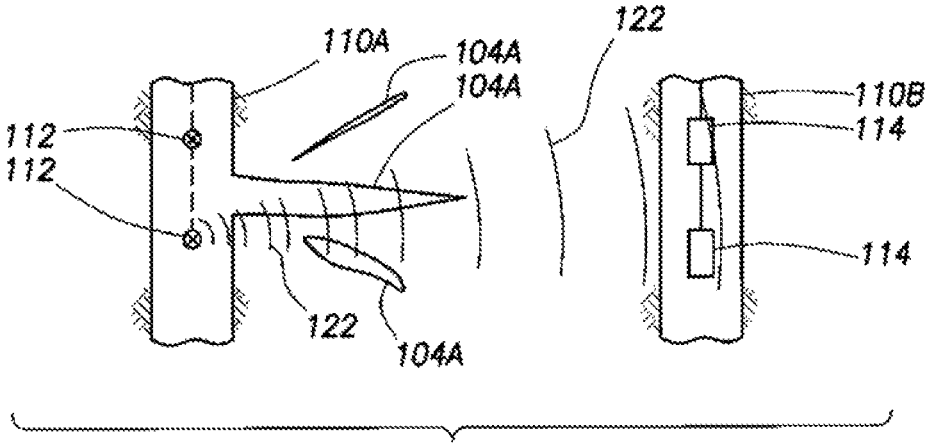
FIGS. 3A-3C are schematic views, partially in cross-section, depicting the system of FIG. 1 performing fracture operations.
Figure 3B:
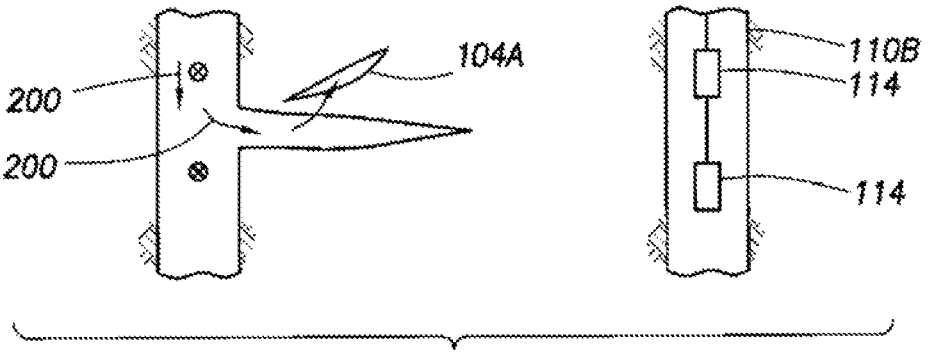
Figure 3C:
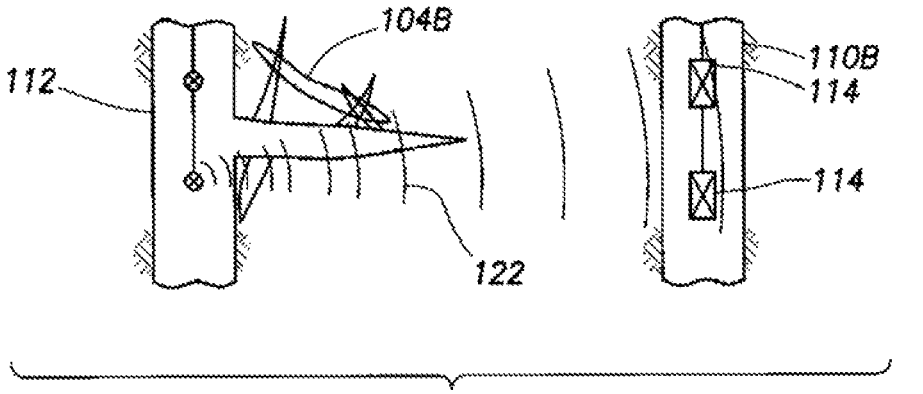

FIGS. 3A-3C are schematic diagrams illustrating the fracture operation. As shown in these figures, the fracture operation may be used to determine one or more fracture parameters of the fracture networks by inducing, measuring and comparing seismic waves 122 before and after reservoir stimulation. Prior to any stimulation of the reservoir 106, the rock is assumed virgin. The fracture parameters of the virgin rock may be dramatically altered after the stimulation of the reservoir 106. Information gathered during the fracture operation may be sent to the controller 118 for storage, analysis etc.

FIG. 3A shows the well site of FIG. 1 prior to stimulation. In this view, one or more of the bi-wing fractures 104A are in fluid communication with the production wellbore 110A. The controlled seismic source 112 is initiated to create a seismic wave 122 through the subterranean formation. Pre-stimulation seismic data is collected by the one or more receivers 114 in the monitoring wellbore 110B.

FIG. 3B shows the well site of FIG. 3A being stimulated. A fracture fluid 200 containing proppants is pumped into the fracture network 104A as described above. The fracture network 104A increases in size and complexity as the stimulation continues. Seismic data is collected by the one or more receivers 114 in the monitoring wellbore 110B during stimulation.

FIG. 3C shows the well site of FIG. 3B after stimulation. The bi-wing fracture has expanded, into a complex fracture network 104B with many sub-fractures in fluid communication. The controlled seismic source 112 is initiated in order to create the seismic wave 122. The post (or after) stimulation seismic data is then collected by the one or more receivers 114 in the monitoring wellbore 110B.

Figure 4:
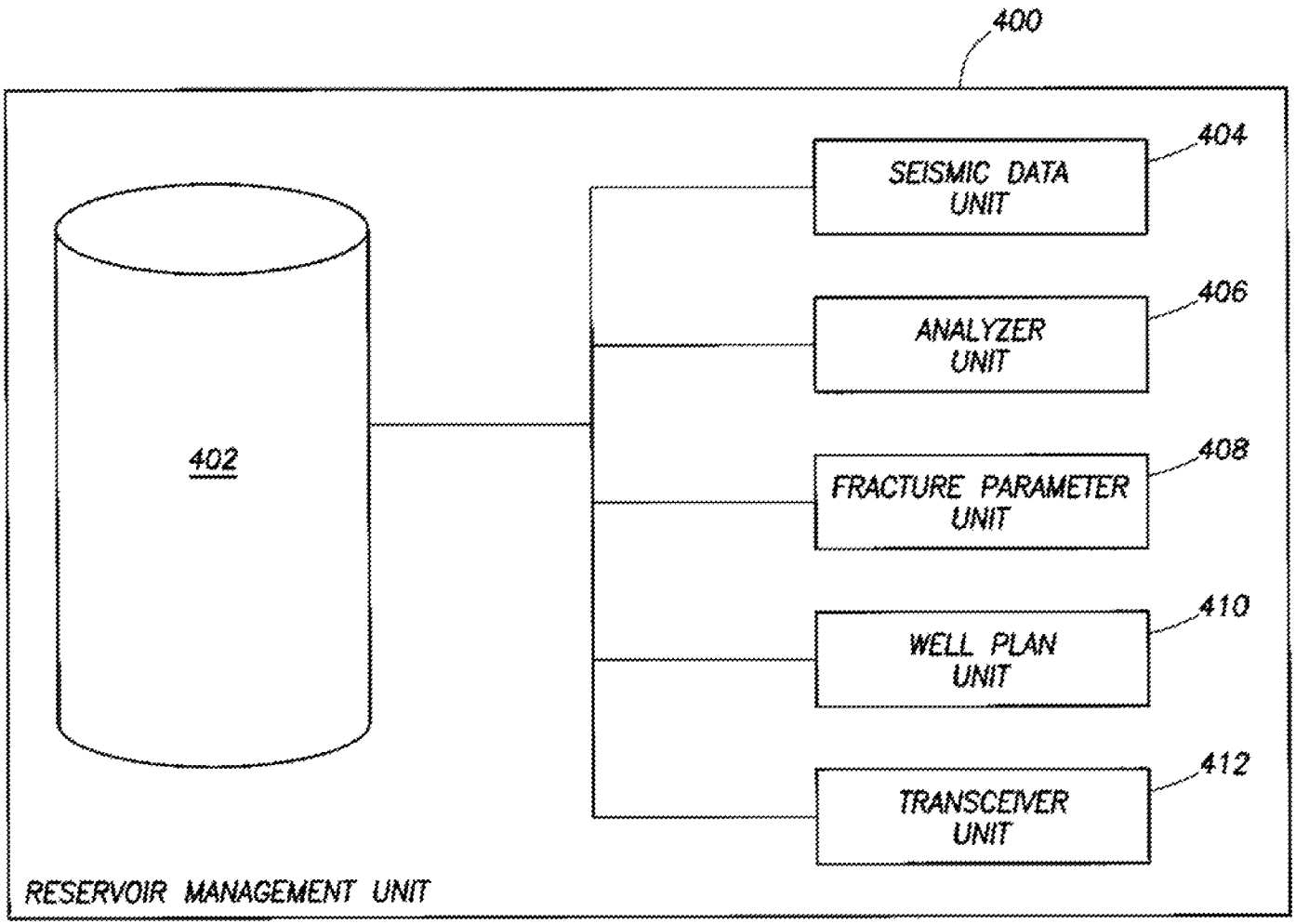
FIG. 4 is a schematic diagram illustrating a reservoir management unit usable with the system of FIG. 1.

FIG. 4 shows a schematic view of reservoir management unit 400. The reservoir management unit 400 may be used in place of controller 118 and/or in combination therewith. The reservoir management unit 400 includes a storage device 402, a seismic unit 404, an analyzer unit 406, a fracture unit 408, a well plan unit 410, and a transceiver unit 412. Part or all of the reservoir management unit 400 may be positioned about the well site and/or at off site locations in, or in communication, with one or more devices (e.g., receivers 114, network 300, source 112, etc.) The reservoir management unit 400 may be wholly or partially included in the controller 118. Further, the reservoir management unit 400 may be wholly or partially included in any of the tools, or devices about the well site 100 and/or offsite.

The storage device 402 may be any conventional database or other storage device capable of storing data associated with the system 102. Such data may include, for example, historical data, operator inputs, seismic data, well site data, stimulation data, reservoir data and production data. The transceiver unit 412 may be any conventional communication device capable of passing signals (e.g., power, communication) to and from the reservoir management unit 400.

The seismic unit 404 receives, analyzes, catalogs and stores the seismic data from the system 102. The seismic data may be, for example, voltage measurements from the receivers 114, or data received from the storage device 402. The seismic, data may be cataloged as a function of time in order to compare the seismic data over the history of the reservoir. The seismic unit 404 may also be catalogued according to the controlled seismic source events. Thus, the seismic unit 404 may catalog the seismic data measured from the controlled seismic event into pre-stimulation seismic data, during stimulation seismic data, and post-stimulation seismic data. The seismic data may also be stored and catalogued for various fractures and/or fracture networks about the well site 100.

The seismic unit 404 may further analyze the cataloged seismic data to determine well site parameters. In particular, the seismic unit 404 may be used to determine seismic properties, such as travel times, frequency, amplitudes, spectral attenuation, S-wave slowness, P-Wave slowness, frequency versus amplitude spectra for the P-waves, frequency versus amplitude spectra for the S-wave, seismic velocity anisotropy, and seismic wave attenuation anisotropy, controlled seismic source location, and the like. In an example, the spectral attenuation may be analyzed according to the seismic event locations. The reservoir attenuation anisotropy may also be determined from the compared spectral attenuation versus location. In another example, frequency versus the amplitude values for the cataloged voltage data may be calculated using conventional techniques, such as the Fast Fourier Transform (FFT) method. The spectral attenuation for the seismic data may be calculated using the frequency versus amplitude values calculated using, for example, the FFT method. The calculated spectra for the P-wave and S-wave spectral attenuation may be analyzed and displayed (see, e.g., FIGS. 5A-G). The seismic unit 404 may also make decisions based on the analyzed information and send command signals to the well site 100.

The analyzer unit 406 may be used to compare the cataloged seismic data and/or seismic properties in order to determine one or more fracture parameters of the fracture networks 104. The analyzer unit 406 may compare the cataloged seismic data and/or seismic properties based on any number of parameters such as, the time the seismic events were collected, the source of the seismic events, the location of the seismic events, the formations the seismic waves travel through, and the like. Thus, the analyzer unit 406 may compare the cataloged seismic data and/or cataloged seismic properties pre-stimulation to the cataloged seismic data and/or cataloged seismic properties during stimulation, and/or post stimulation. From the comparison of the data and/or the properties, well site information may be determined. Although, the analyzer unit 406 is described as only comparing seismic data and/or seismic properties, it should be appreciated that the analyzer unit 406 may incorporate other data regarding the fracture networks 104 and/or the subterranean formation 105, such as pressure data, temperature data, and the like.

The reservoir information determined by the analyzer unit 406 may include any of the fracture parameters. The fracture parameters may be received, analyzed, cataloged and stored by the fracture unit 408. The fracture parameters cataloged and stored by the fracture unit 408 may provide detailed information regarding the fracture networks 104 at different times during the drilling operation. For example, the fracture parameter determined by the analyzer unit 406, and stored by the fracture unit 408, may be the fracture density of the fracture network 104. The fracture density may be estimated using the attenuation of the seismic waves as a function of the direction from the receiver array. The fracture density may be determined along an azimuth on a horizontal plane intersecting the receivers and radially from the receivers to give a depth or height above a horizontal plane intersecting the receivers.

The well, plan unit 410 may receive data from the storage unit 402, the seismic unit 404, the analyzer unit 406, the fracture unit 408 and/or other sources. The information may be combined and/or analyzed in order to create and/or modify a well plan, or a portion of the well plan. The well plan unit 410 may provide, for example, a plan or strategy for optimizing production from the reservoir 106 while trying to minimize costs and time required to produce the reservoir 106.

The well plan unit 410 may be used to modify fracture operations, such as stimulation treatments. For example, if the fracture parameter is the fracture density, the well plan unit 410 may determine that the fracture density is not changing dramatically pre and post stimulation. The well plan unit 410 may modify the well plan to reduce the number of treatments in the reservoir 106 in an effort to save time and money. The well plan unit 410 may also determine that the proppant being used for the treatments is not small enough to penetrate the majority of the mapped post treatment fractures. The well plan unit 410 may adjust the size of the proppant being used in future stimulations. Further, the well plan unit 410 may adjust any portion of well plan based on the fracture parameters, and the mapped fracture network including, but not limited to, infill drilling, drilling pattern, drilling orientation, completion method, stimulation method, and the like.

The systems depicted in the reservoir management unit 400 may take the form of entirely hardware, entirely software (including firmware, resident software, micro-code, etc.) or a combination of software and hardware. The systems may take the form of a computer program embodied in any medium having computer usable program code embodied in the medium. The systems may be provided as a computer program product, or software, that may include, a machine-readable medium having stored thereon instructions, which may be used to program a computer system (or other electronic device(s)) to perform a process. A machine readable medium includes any mechanism for storing or transmitting information in a form (such as, software, processing application) readable by a machine (such as a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. The reservoir management unit 400 may further be embodied in an electrical, optical, acoustical or other form of propagated signal (e.g., carrier waves, infrared signals, digital signals, etc.), or wireline, wireless, or other communications medium. Further, it should be appreciated that the reservoir management unit 400 may take the form of hand calculations, or operator comparisons. To this end, the operator, or engineer(s) may receive, manipulate, catalog and store the data from the system 102 in order to perform task depicted in the reservoir management unit 400.

FIGS. 2 and 5A-5G show various displays that may be generated by the reservoir management unit 400 of FIG. 4 depicting the operation of the devices on FIG. 1. As shown in these figures, data collected concerning the fracture operation may be processed, analyzed and assembled in the desired format for display. The format may involve two or three dimensional displays of the fracture operation, data and/or parameters.

Figure 5A:
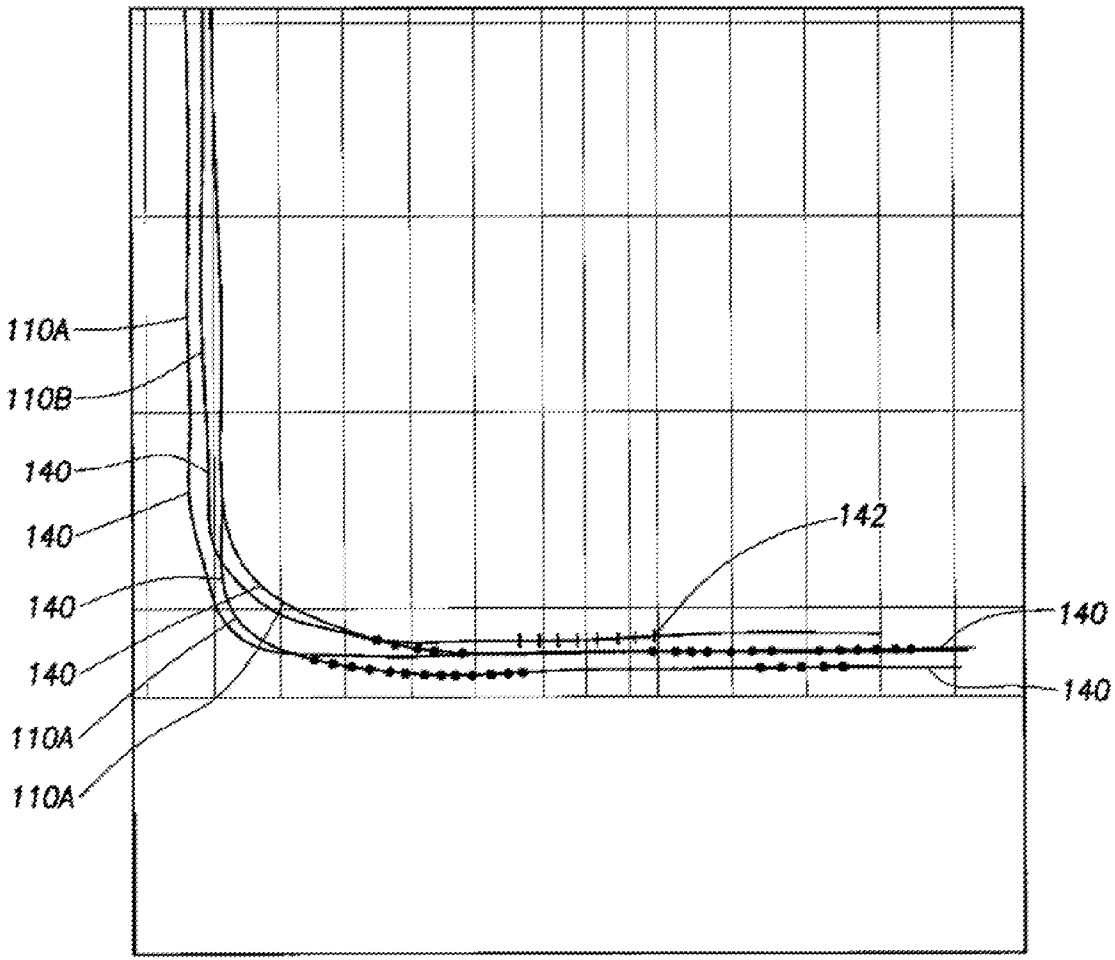
FIGS. 5A-5G are plots depicting displays generated by, for example, the reservoir management unit of FIG. 4.
Figure 5B:
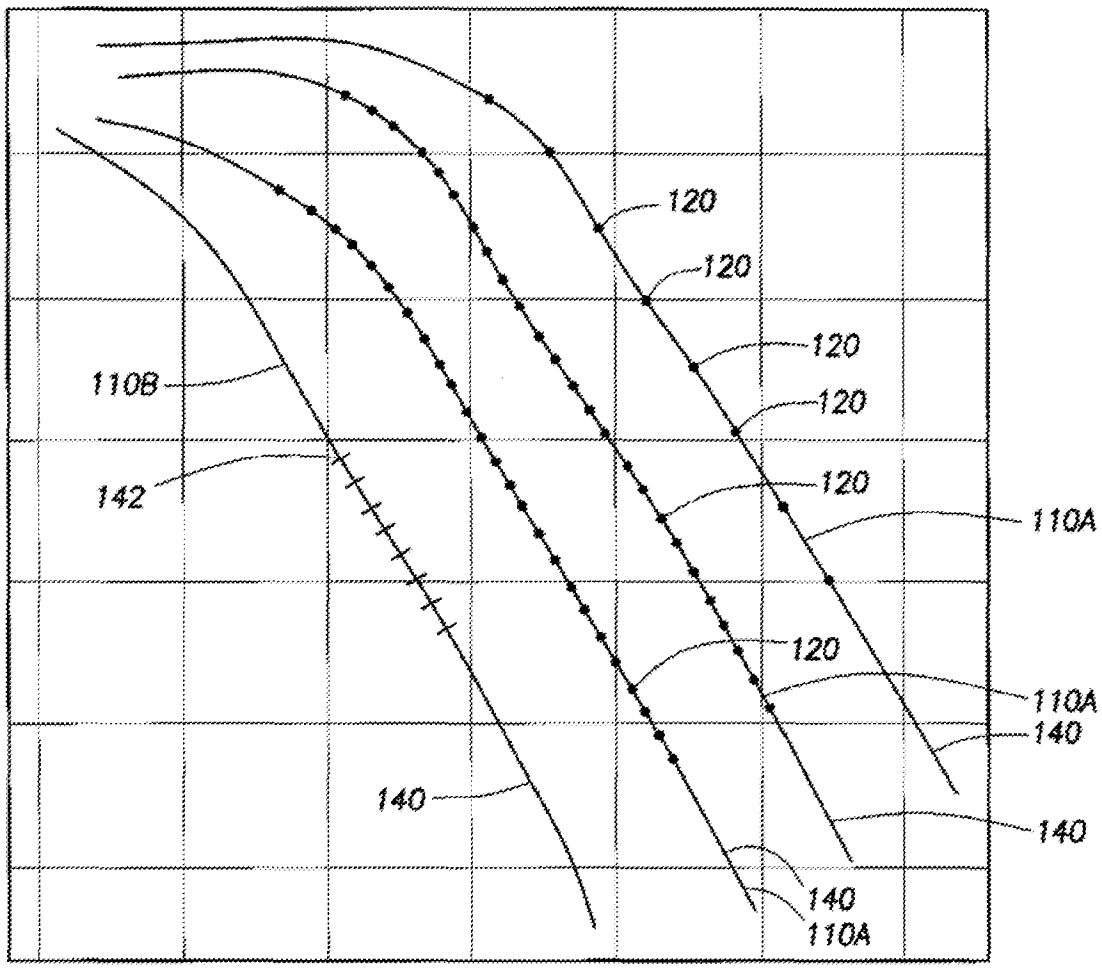
Figure 5C:
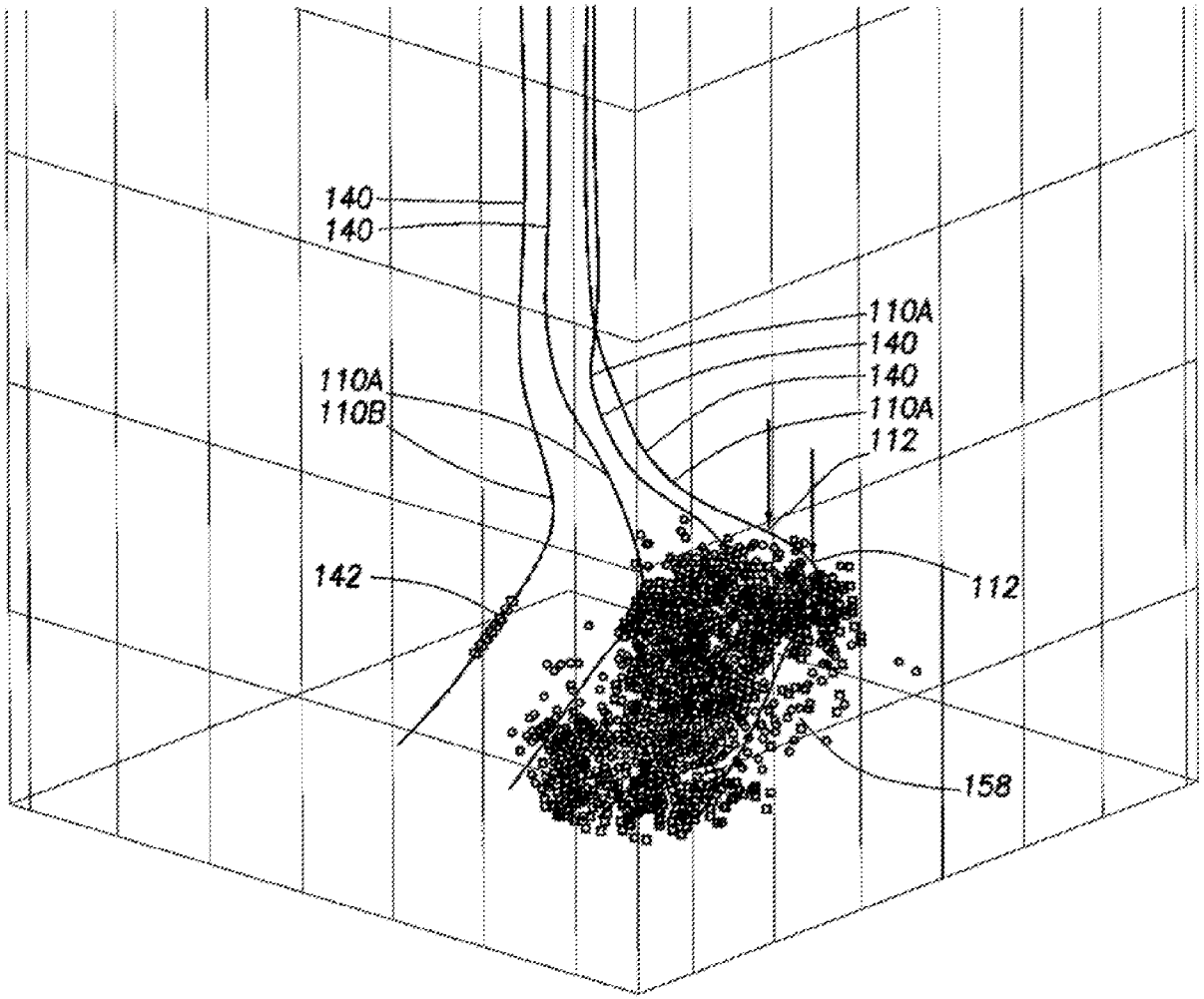

FIGS. 5A-5C show a recording geometry of the data collected using the system 102 of FIG. 1 before, during and after stimulation. FIG. 5A shows the recording geometry in an elevation, or, cross-sectional view. Thus, the vertical axis is the depth of the wellbores and the horizontal axis is the horizontal distance the wellbores traverse. FIG. 5B shows the recording geometry in map view. Thus, the view in FIG. 5B is from above and the vertical and horizontal axis represent distances in the horizontal directions, for example North-South, and East-West. In FIGS. 5A and 5B, the wellbores 110A and B are displayed as a solid lines 140 and the receivers 114 are displayed as a disc 142. As shown, there are multiple wellbores 110A and one monitoring wellbore 110B. The microseismic source 112 locations are shown as rectangles. In this example, the recording geometry of the receivers 114 may utilize a horizontal deployment of geophones. This recording geometry may allow for the collection of controlled seismic source events used as part of the well completion process, in addition to the microseismic events. As the stimulation treatment proceeds, certain controlled seismic source events may be recorded with ray paths traversing a rock volume, or formation, that was treated during the previous stage.

FIG. 5C shows an oblique cross-sectional view of the recording geometry of FIGS. 5A and 5B. This figure shows an example, of a previously treated zone, or formation, of the reservoir 106 located between the controlled seismic source event and the receivers 114. From the seismic data from the controlled seismic source 112, the seismic wave spectra and seismic wave travel-times through the reservoir 106 prior to treatment may be measured. These measurements may then be compared to seismic wave spectra and seismic wave travel-times through the reservoir volume which has undergone stimulation, as will be discussed in more detail below. As shown in FIG. 5C the spheres 158 may represent hypocentral locations of microseismic events created by hydraulic fracturing of the reservoir. The seismic events created by the controlled seismic source 112 may traverse the previously stimulated formation, or rock volumes, to reach the receivers 114.

Figure 5D:
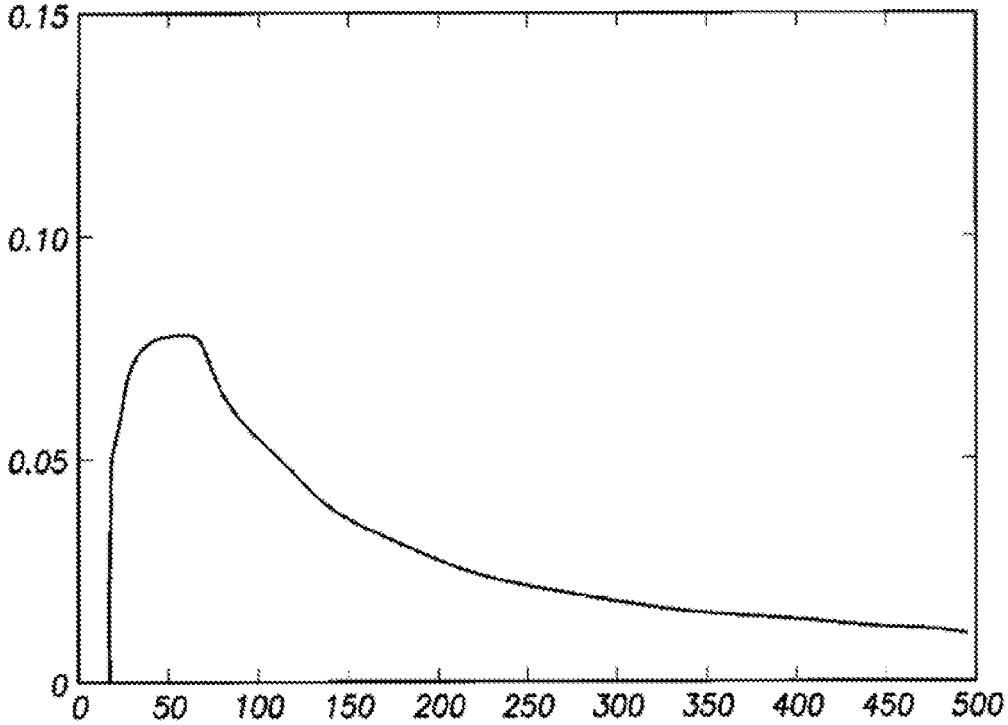
Figure 5E:
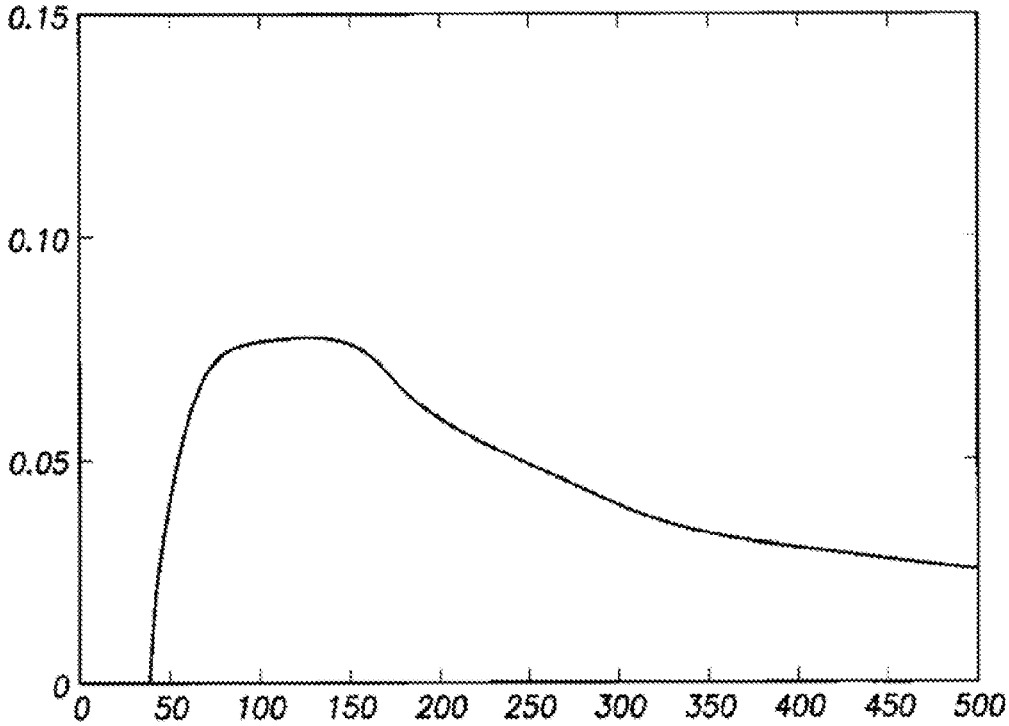
Figure 5F:
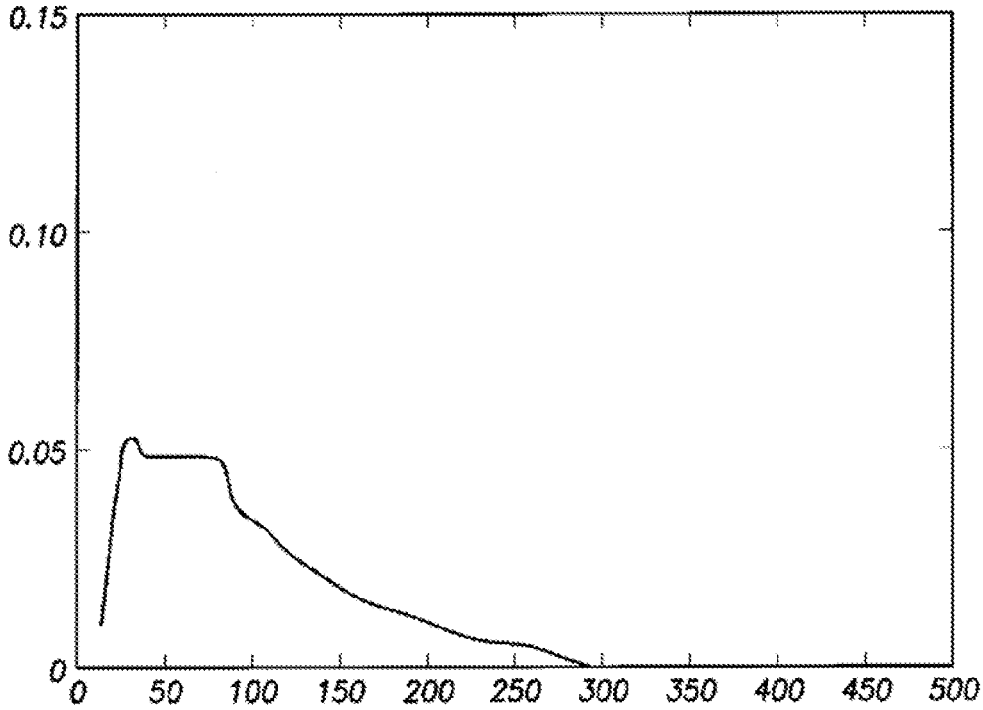
Figure 5G:
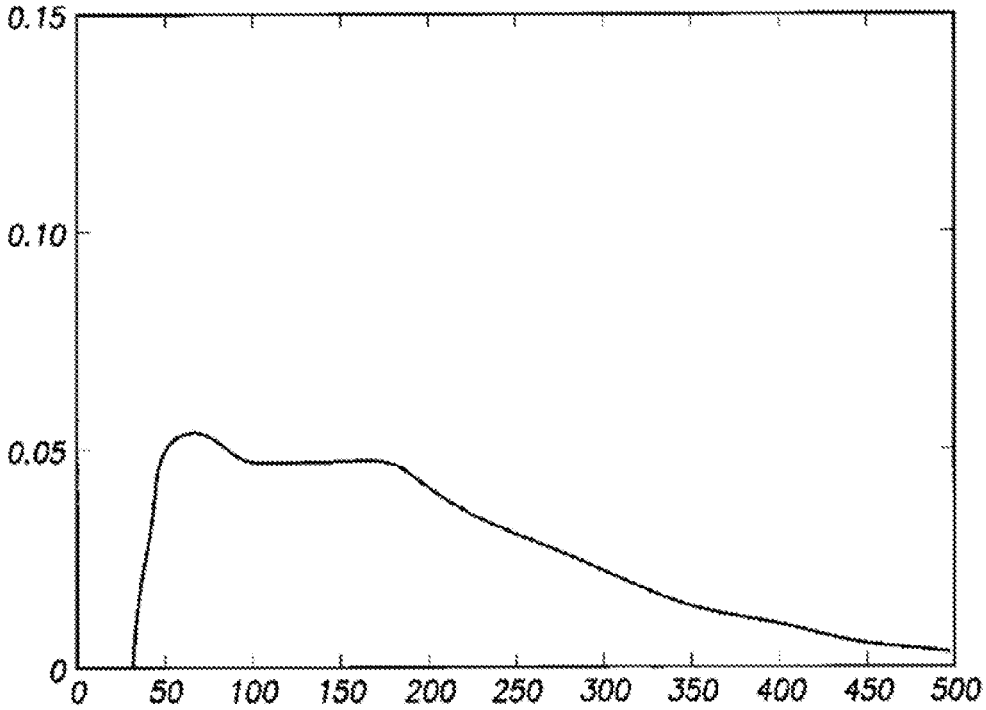

FIGS. 5D-G are line plots depicting attenuations of a perforation shot frequencies traveling through the formation. FIGS. 5D and 5E show the frequencies before stimulation. FIGS. 5F and 5G show the frequencies after stimulation. The seismic waves 122 may include compression primary waves or P-waves, the shear secondary waves or S-waves, and/or the residual S-coda waves. Seismic attenuation of the P-waves and S-waves from the controlled seismic source 112 may vary from an untreated reservoir volume and a treated reservoir volume. For example, in the treated reservoir the P-wave from the controlled seismic source may have fully attenuated in the range of 290-500 Hz, as shown in FIG. 5F. Further, in the treated reservoir, the S-wave from the controlled seismic source, may be fully attenuated at 500 Hz, as shown in FIG. 5G. In contrast the P-wave and S-waves from the same type of controlled seismic source in an untreated reservoir may not have attenuated frequencies in the range of 290-500 Hz, for the P-wave, as shown in FIG. 5D, nor at 500 Hz for the S-Wave, as shown in FIG. 5E.

Figure 6:
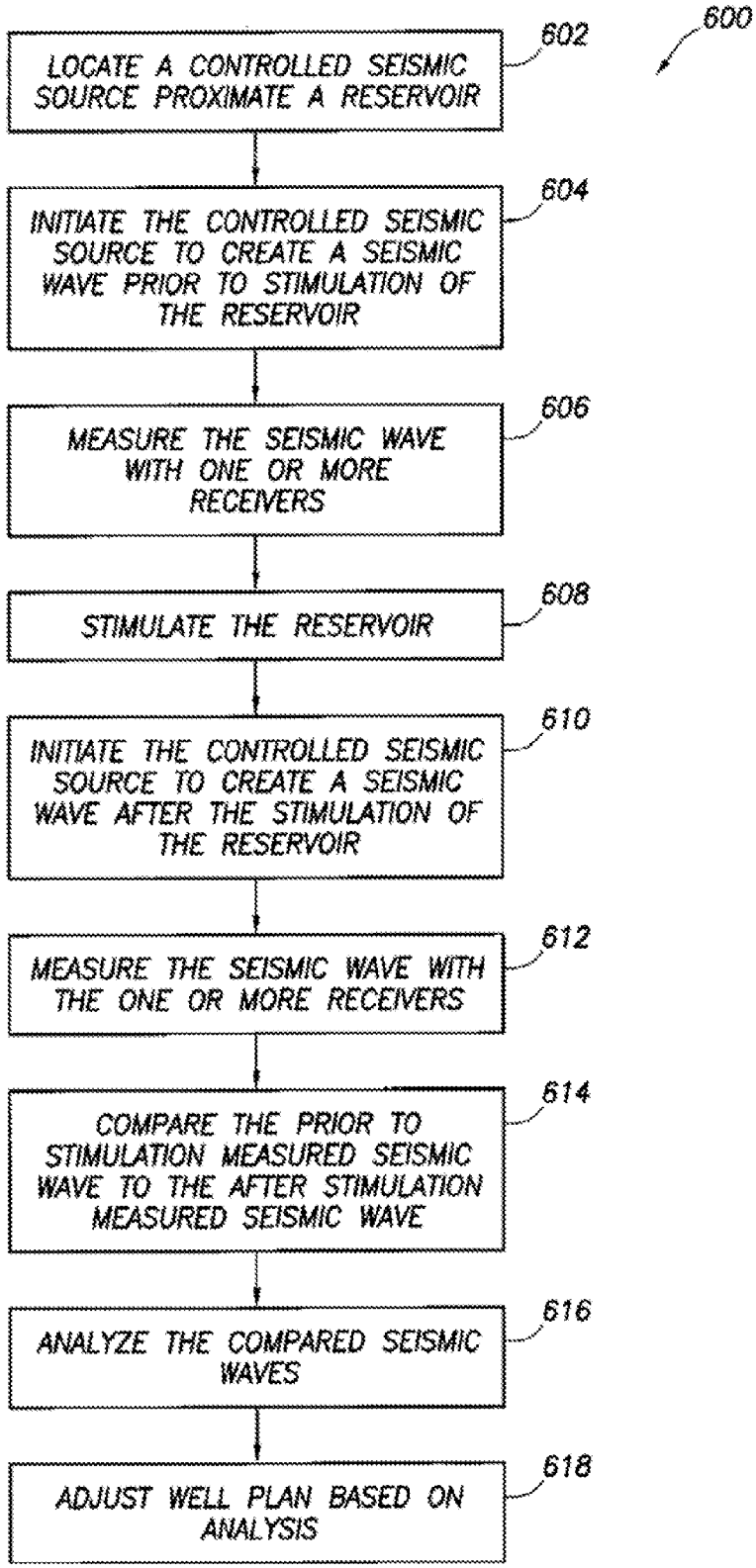
FIG. 6 depicts a flow diagram illustrating a method of performing a fracture operation.

FIG. 6 is a flow diagram illustrating a method (600) of performing a fracture operation. The method involves locating (602) a seismic controlled source (see, e.g., 112 of FIG. 3A) proximate the reservoir (see, e.g., 106 of FIG. 1), initiating (604) the controlled seismic source 112 prior to a stimulation of the reservoir 106 to create one or more seismic waves therethrough (see, e.g., 122 of FIG. 3A), and measuring (606) the seismic wave with the one or more receivers (see, e.g., 114 of FIG. 3A). The method further involves stimulating (608) the reservoir (see, e.g., 106 FIG. 3B), initiating (610) the controlled seismic source (see, e.g., 112 of FIG. 3C) after the stimulation of the reservoir 106, and measuring (612) the seismic wave 122 with the receiver(s) (see, e.g., 114 of FIG. 3C). The method further involves comparing (614) the measured seismic waves prior to stimulation and post stimulation (see, e.g., FIGS. 3A, 3C).

The method may further involve analyzing (616) the compared seismic waves. The analysis may involve determining one or more fracture parameters, for example using the reservoir management unit (see, e.g., 400 of FIG. 4), and/or displaying the results (see, e.g., FIGS. 2, 5A-5G). The one or more fracture parameters may also be stored, cataloged and/or manipulated in, for example, the reservoir management unit 400.

The well plan may be adjusted (618) based on the analysis of, for example, the determined fracture parameters. The well plan may be compared to the fracture parameter in order to determine if the fracture parameter is consistent with the well plan using the reservoir management unit 400. If the fracture parameter is consistent with the well plan, the operator and/or controller (see, e.g., 118 of FIG. 1) may continue to follow the well plan. If the fracture parameter is not consistent with the well plan, the well plan may be modified to better suit the fracture parameter. Once the well plan is modified, the oilfield operations may be performed according to the modified well plan.

While the embodiments are described with reference to various implementations and exploitations, it will be understood that these embodiments are illustrative and that the scope of the inventive subject matter is not limited to them. Many variations, modifications, additions and improvements are possible. For example, additional sources and/or receivers may be located about the wellbore to perform seismic operations.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A method for managing a well site having a subterranean formation, comprising:

determining a first spectral attenuation of a first seismic wave measured from a first location;

determining a second spectral attenuation of a second seismic wave measured from a second location;

determining a reservoir attenuation anisotropy from a comparison of the first spectral attenuation to the second spectral attenuation; and determining at least one fracture parameter of the subterranean formation from a comparison of the first seismic wave to the second seismic wave.

2. The method of claim 1, further comprising stimulating the reservoir.

3. The method of claim 1, further comprising locating at least one controlled source proximate the subterranean formation.

4. The method of claim 1, further comprising initiating an initial seismic wave from at least one seismic source, wherein the reflections of the initial seismic wave are measured as the first seismic wave.

5. The method of claim 1, further comprising initiating an initial seismic wave from at least one seismic source, wherein the reflections of the initial seismic wave are measured as the second seismic wave.

6. The method of claim 1, wherein the at least one fracture parameter comprises one of fracture density, hydraulic conductivity, the fracture width, fracture porosity, local stress field, reservoir attenuation anisotropy, seismic wave velocities through the fractures, the fluid pressure, the fracture length, the fracture conductivity and combinations thereof.

7. The method of claim 1, further comprising adjusting a well plan based on the at least one fracture parameter.

8. The method of claim 7, wherein adjusting a well plan further comprises adjusting the frequency of reservoir stimulations.

9. A system for performing a fracture operation on a subterranean formation, comprising:

a first seismic source positioned at a first location about the subterranean formation for generating a first seismic wave therethrough;

a second seismic source positioned at a second location about the subterranean formation for generating a second seismic wave therethrough;

a receiver positionable about the subterranean formation for receiving reflections of the first and second seismic waves; and a reservoir management unit for determining at least one fracture parameter of the subterranean formation by comparing the first seismic wave to the second seismic wave, determining a first spectral attenuation of the reflections of the first seismic wave, determining a second spectral attenuation corresponding to reflections of the second seismic wave, and determining a reservoir attenuation anisotropy from a comparison of the first spectral attenuation to the second spectral attenuation.

10. The system of claim 9, further comprising a stimulation system for stimulating at least one fracture in the subterranean formation.

11. The system of claim 9, wherein the first seismic source comprises a perforation gun.

12. The system of claim 9, wherein the second seismic source comprises a perforation gun.

13. The system of claim 9, wherein the receiver comprises a geophone.

14. The system of claim 9, wherein the reservoir management unit comprises a seismic unit for converting and storing seismic data received by the at least one receiver into seismic properties.

15. The system of claim 9, wherein the reservoir management unit comprises a fracture unit.

16. The system of claim 9, wherein the reservoir management unit comprises an analyzer unit for determining the at least one fracture parameter.

17. The system of claim 9, wherein the reservoir management unit comprises a well plan unit for determining if a current well plan is consistent with the at least one determined fracture parameter.

18. The system of claim 9, wherein the reservoir management unit comprises a storage device.

19. The system of claim 9, wherein the reservoir management unit comprises a transceiver.

20. The system of claim 9, further comprising a network operatively connectable to the reservoir management unit for communication therewith.

21. The system of claim 9, wherein the at least one fracture parameter comprises one of fracture density, hydraulic conductivity, the fracture width, fracture porosity, local stress field, reservoir attenuation anisotropy, seismic wave velocities through the fractures, the fluid pressure, the fracture length, the fracture conductivity and combinations thereof.

22. A system for managing a well site having a subterranean formation; comprising:

a controller configured to determine a first spectral attenuation of a first seismic wave measured from a first location, determine a second spectral attenuation of a second seismic wave measured from a second location, determine a reservoir attenuation anisotropy from a comparison of the first spectral attenuation to the second spectral attenuation, and determine at least one fracture parameter of the subterranean formation from a comparison of the first seismic wave to the second seismic wave.

23. The system of claim 22, wherein the first seismic wave is measured before stimulation of the subterranean formation.

24. The system of claim 22, wherein the second seismic wave is measured after stimulation of the subterranean formation.

25. The system of claim 22, wherein the controller is further configured to initiate stimulation of the subterranean formation.

26. The system of claim 22, wherein the controller is further configured to initiate a seismic source to create an initial seismic wave, the reflections of which from at least a portion of the subterranean formation are measured as the first seismic wave.

27. The system of claim 22, wherein the controller is further configured to initiate a seismic source to create an initial seismic wave, the reflections of which from at least a portion of the subterranean formation are measured as the second seismic wave.

28. The method of claim 22, wherein, the at least one fracture parameter comprises one of fracture density, hydraulic conductivity, the fracture width, fracture porosity, local stress field, reservoir attenuation anisotropy, seismic wave velocities through the fractures, the fluid pressure, the fracture length, the fracture conductivity and combinations thereof.

* * * * *